US010753136B2

(12) United States Patent
Jiang

(10) Patent No.: US 10,753,136 B2
(45) Date of Patent: Aug. 25, 2020

(54) METHOD AND MECHANISM FOR AUTOMATICALLY DETECTING DOOR OR WINDOW FAULTS

(71) Applicant: Beijing Eco-Smart Automation Control Technology Co., Ltd., Beijing (CN)

(72) Inventor: Xiaowei Jiang, Beijing (CN)

(73) Assignee: BEIJING ECO-SMART AUTOMATION CONTROL TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/408,471

(22) Filed: Jan. 18, 2017

(65) Prior Publication Data

US 2018/0058125 A1 Mar. 1, 2018

(30) Foreign Application Priority Data

Aug. 23, 2016 (CN) ..... 2016 1 0711307

(51) Int. Cl.
*G08B 13/08* (2006.01)
*E05F 7/00* (2006.01)
(Continued)

(52) U.S. Cl.
CPC ..... *E05F 7/00* (2013.01); *E05F 11/54* (2013.01); *E06B 7/28* (2013.01); *G08B 13/06* (2013.01);
(Continued)

(58) Field of Classification Search
CPC .... E05F 7/00; E05F 11/54; E06B 7/28; E05Y 2800/404; E05Y 2800/426
See application file for complete search history.

(56) References Cited

U.S. PATENT DOCUMENTS 4,990,888 A * 2/1991 Vogt ..... G08B 26/002 340/505
5,712,621 A * 1/1998 Andersen ..... G08B 13/08 324/207.16
(Continued)

FOREIGN PATENT DOCUMENTS

CN 103670515 A 3/2014
CN 105 275 306 A 1/2016
(Continued)

OTHER PUBLICATIONS

European Search Report, Extended, and Written Opinion dated Aug. 4, 2017 for Application No. EP 17151660.2, 21 pgs.
(Continued)

*Primary Examiner* — Jerry E Redman
(74) *Attorney, Agent, or Firm* — Frost Brown Todd LLC

(57) ABSTRACT

The present invention discloses a method for automatically detecting door or window faults, comprising the following steps: mounting a displacement sensor at at least one monitoring position of the door or window frame and leaf and/or door or window hardware to monitor a relative position change of the door or window frame and leaf and/or relative displacement of the hardware at said at least one monitoring position; and connecting the displacement sensor to a controller which judges whether the relative position change of the door or window frame and leaf and/or relative displacement of the hardware at said at least one monitoring position exceeds a displacement threshold, and thereby perform combined judgment for door or window faults. The present invention further discloses a mechanism for automatically detecting door or window faults. The present invention can automatically detect possible faults occurring during use of the door or window, and thereby eliminate hidden risks
(Continued)

endangering the user and other persons' personal safety, and exhibit important social significance.

15 Claims, 8 Drawing Sheets

(51) Int. Cl.
*E05F 11/54* (2006.01)
*G08B 13/06* (2006.01)
*E06B 7/28* (2006.01)

(52) U.S. Cl.
CPC ..... *G08B 13/08* (2013.01); *E05Y 2800/404* (2013.01); *E05Y 2800/426* (2013.01)

(56) References Cited

U.S. PATENT DOCUMENTS 6,310,549 B1 * 10/2001 Loftin ..... G08B 13/08 324/207.21
6,472,993 B1 * 10/2002 Addy ..... G08B 13/08 340/539.1
6,609,738 B1 * 8/2003 Roth ..... E05B 65/108 292/144
9,842,488 B2 * 12/2017 Paulson ..... G08B 25/008
9,953,503 B2 * 4/2018 Smith ..... G08B 13/02
2009/0026355 A1 * 1/2009 Anderson ..... G08B 13/08 250/221
2009/0027199 A1 * 1/2009 DiPoala ..... G08B 13/08 340/547
2010/0115853 A1 * 5/2010 Gebhart ..... H02P 6/085 49/506
2012/0212001 A1 * 8/2012 Benitez ..... E05B 17/22 292/251.5
2013/0263511 A1 * 10/2013 Agam ..... G01S 7/527 49/31
2014/0262057 A1 * 9/2014 Chambers ..... E06B 9/68 160/5
2015/0226001 A1 * 8/2015 Adams ..... E06B 9/72 160/84.02
2015/0348385 A1 * 12/2015 Lamb ..... G08B 13/08 340/547
2016/0054148 A1 * 2/2016 Misfatto ..... E05B 39/00 73/514.02
2016/0187118 A1 * 6/2016 Modi ..... G01B 7/14 340/815.45
2016/0187368 A1 * 6/2016 Modi ..... G08B 13/08 702/141
2016/0189506 A1 * 6/2016 Peterson ..... G08B 13/24 340/551
2016/0189527 A1 * 6/2016 Peterson ..... G08B 25/008 340/541
2016/0189529 A1 * 6/2016 Lee ..... G08B 25/008 340/541
2016/0319570 A1 * 11/2016 Wong ..... E05B 43/005
2017/0043649 A1 * 2/2017 Heirtzler ..... B60J 5/0468
2017/0075323 A1 * 3/2017 Shrivastava ..... G06Q 50/10
2017/0198496 A1 * 7/2017 Beck ..... E05B 17/22
2017/0285432 A1 * 10/2017 Shrivastava ..... G05B 15/02
2018/0016834 A1 * 1/2018 Wislicki ..... E05F 15/50
2018/0082503 A1 * 3/2018 Kvinge ..... G07C 9/00309
2018/0129172 A1 * 5/2018 Shrivastava ..... G05B 15/02
2018/0363351 A1 12/2018 Jiang

FOREIGN PATENT DOCUMENTS

DE 20 2016 000785 U1 3/2016
EP 2 520 747 A2 11/2012
EP 2 520 747 A3 8/2015

OTHER PUBLICATIONS

Chinese Office Action for Application No. 201610711307.1, dated Jul. 4, 2017, 9 pages.
European Office Action for Application No. 17151660.2, dated Nov. 20, 2018, 5 pages.

* cited by examiner

METHOD AND MECHANISM FOR AUTOMATICALLY DETECTING DOOR OR WINDOW FAULTS

FIELD OF THE INVENTION

The present invention relates to the field of doors and windows, and particularly to a method for automatically detecting door or window faults. The present invention further relates to a mechanism for automatically detecting door or window faults.

BACKGROUND OF THE INVENTION

During use of doors and windows, different faults to doors and windows might be caused with elapse of time or wrong use of a user. If the faults are not handled in time, damages might be caused to the user or other groups of persons. For example, loosening of door and window hardware, fall of doors and windows and serious corner deformation, etc. cause collision between a leaf and a frame or between a leaf and ground and failure to use normally.

SUMMARY OF THE INVENTION

In view of the above problems and other problems existing in the prior art, the present invention proposes a method and mechanism for automatically detecting door or window faults.

Correspondingly, the present invention provides a method for automatically detecting door or window faults, comprising the following steps: mounting a displacement sensor at at least one monitoring position of the door or window frame and leaf and/or door or window hardware to monitor a relative position change of the door or window frame and leaf and/or relative displacement of hardware at said at least one monitoring position; and connecting the displacement sensor to a controller which judges whether the relative position change of the door or window frame and leaf and/or relative displacement of hardware at said at least one monitoring position exceeds a displacement threshold, and thereby perform combined judgment for door or window faults.

Preferably, the displacement sensor is a reed pipe and a magnet.

Preferably, mounting a displacement sensor at at least one monitoring position of the door or window frame and leaf and/or door or window hardware comprises mounting the displacement sensor on a mounting plate of a hinge for mounting on the door or window leaf and frame and a hinge sheet, and mounting the displacement sensor at a lock seat and a lock point on the door or window on the side of a handle.

Preferably, the method further comprises the following step: sending fault explanation information via the controller, transmitting the information to a master controller in a wired or wireless transmission manner, using a human-machine interaction interface to display a fault code and indicate fault information.

Preferably, the method further comprises the following step: sending fault explanation information via the controller, transmitting the information to a master controller in a wired or wireless transmission manner, transmitting the fault information to a cloud server by the master controller via a router, and transmitting the fault information to the user's mobile terminal via the cloud server.

The present invention further provides a mechanism for automatically detecting door or window faults, comprising: a displacement sensor mounted at at least one monitoring position of the door or window frame and leaf and/or door or window hardware; and a controller connected to the displacement sensor and configured to judge whether a relative position change of the door or window frame and leaf and/or relative displacement of hardware at said at least one monitoring position exceeds a displacement threshold, and thereby perform combined judgment for door or window faults.

Preferably, the displacement sensor is a reed pipe and a magnet.

Preferably, the displacement sensor mounted at at least one monitoring position of the door or window frame and leaf and/or door or window hardware comprises a displacement sensor mounted on a mounting plate of a hinge for mounting on the door or window leaf and frame and a hinge sheet, and a displacement sensor mounted at a lock seat and a lock point on the door or window on the side of a handle.

Preferably, the mechanism further comprises a master controller, the fault explanation information sent by the controller being transmitted to the master controller in a wired or wireless transmission manner, the master controller using a human-machine interaction interface to display a fault code and indicate fault information.

Preferably, the mechanism further comprises a master controller, the fault explanation information sent by the controller being transmitted to the master controller in a wired or wireless transmission manner, the fault information being transmitted to a cloud server by the master controller via a router, being transmitted to the user's mobile terminal via the cloud server.

Based on relationship between door or window hardware and associated structures, and from perspective of states and association relationship of hardware, the present invention solves the problem about how to judge whether hardware states are normal and whether relative dimensions of hardware and door or window leaf and frame are normal, thereby automatically judging whether the door or window is faulty during use without need to manually inspect and find various faults, and thereby eliminating hidden risks endangering the user and other persons' personal safety, and exhibiting important social significance.

DETAILED DESCRIPTION OF PREFERRED EMBODIMENTS

Hereunder, a method and mechanism for automatically detecting faults of a door or window according to the present invention are described in detail with reference to the figures.

Figure 1:
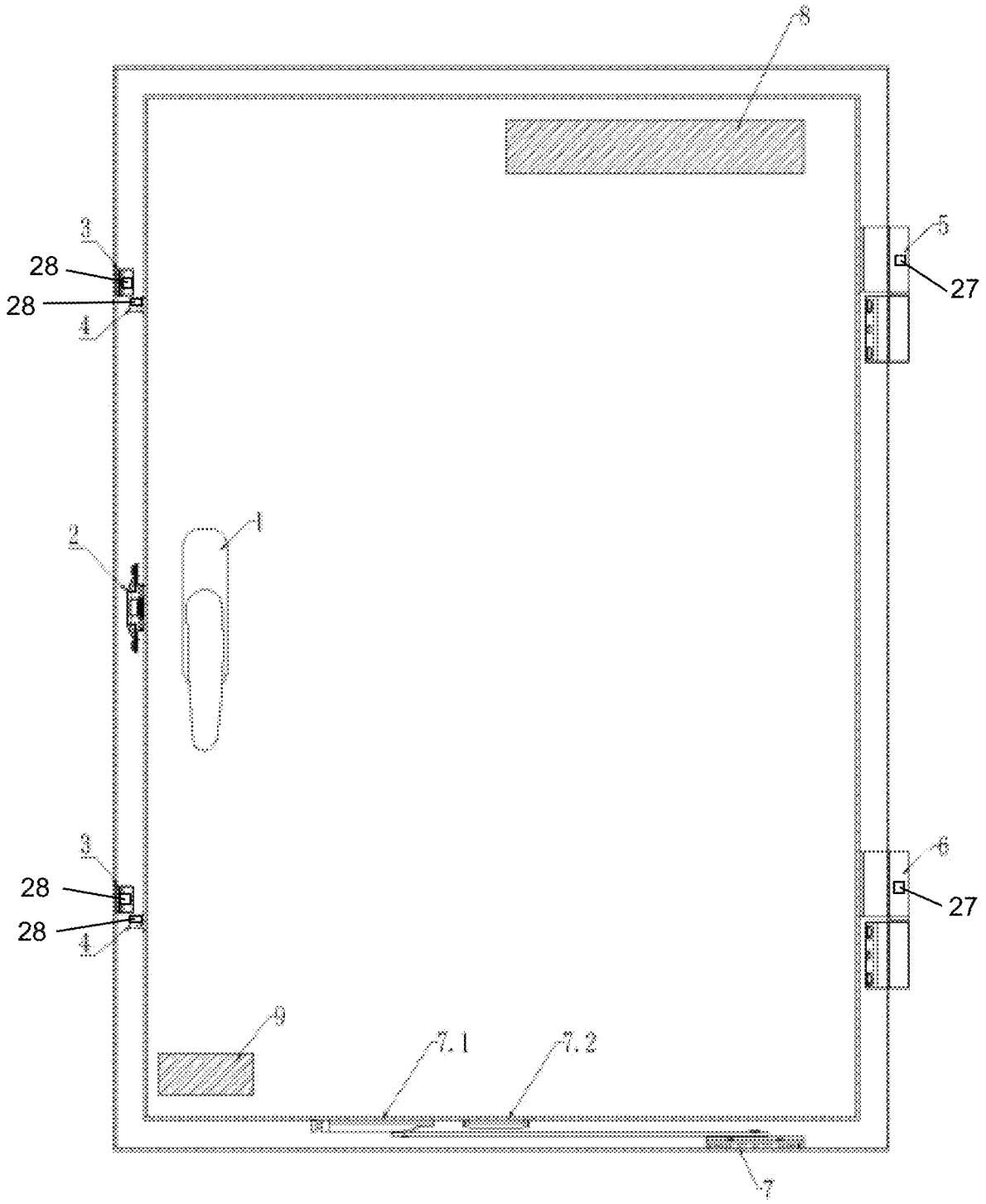
FIG. 1 is a schematic view of a door or window with a mechanism for automatically detecting faults of the door or window according to an embodiment of the present invention.
Figure 2:
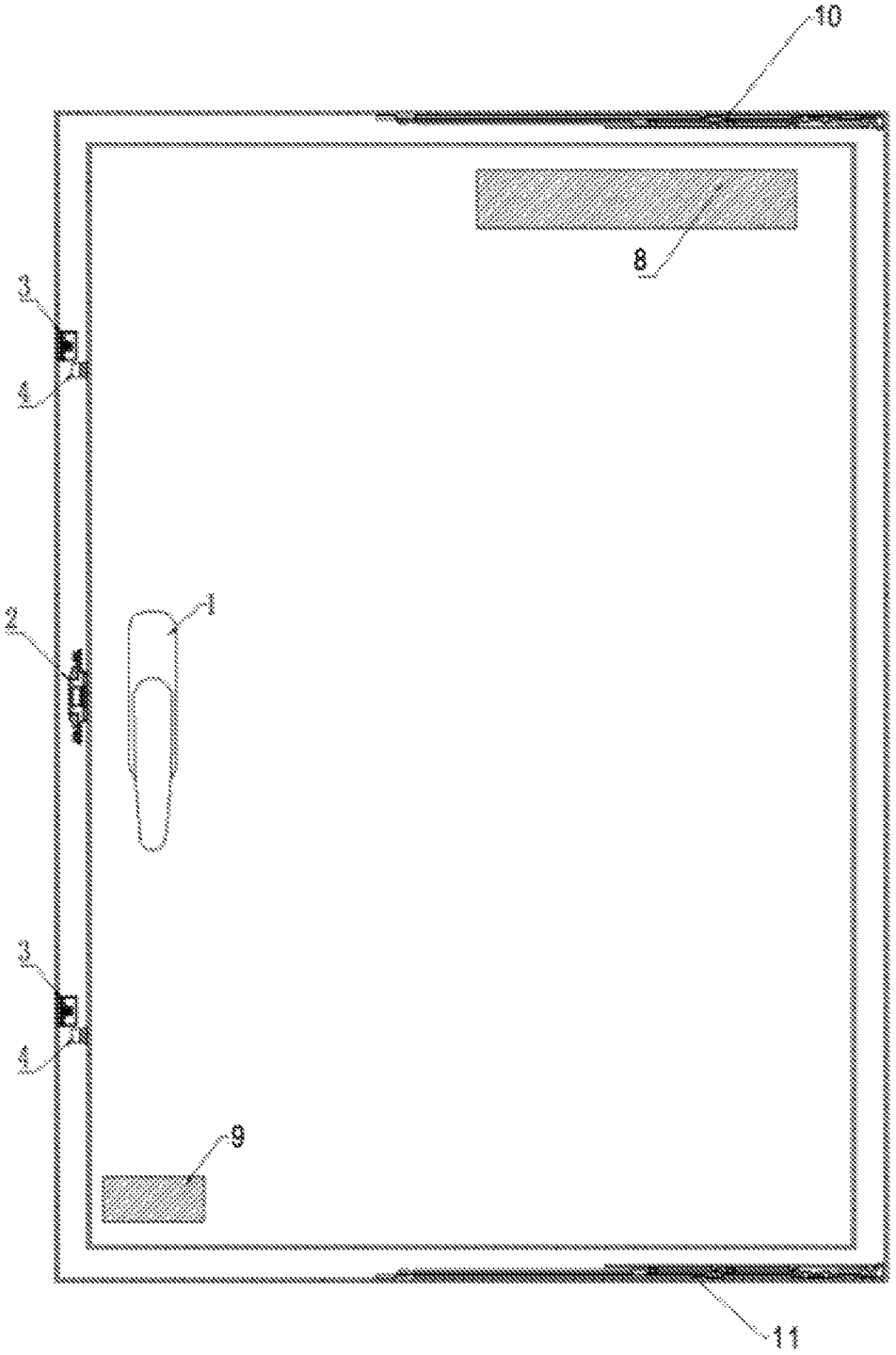
FIG. 2-FIG. 6 illustrate other types of doors or windows on which the mechanism for automatically detecting faults of the doors or windows is arranged out of the same concept as FIG. 1, but arranged at different positions.
Figure 3:
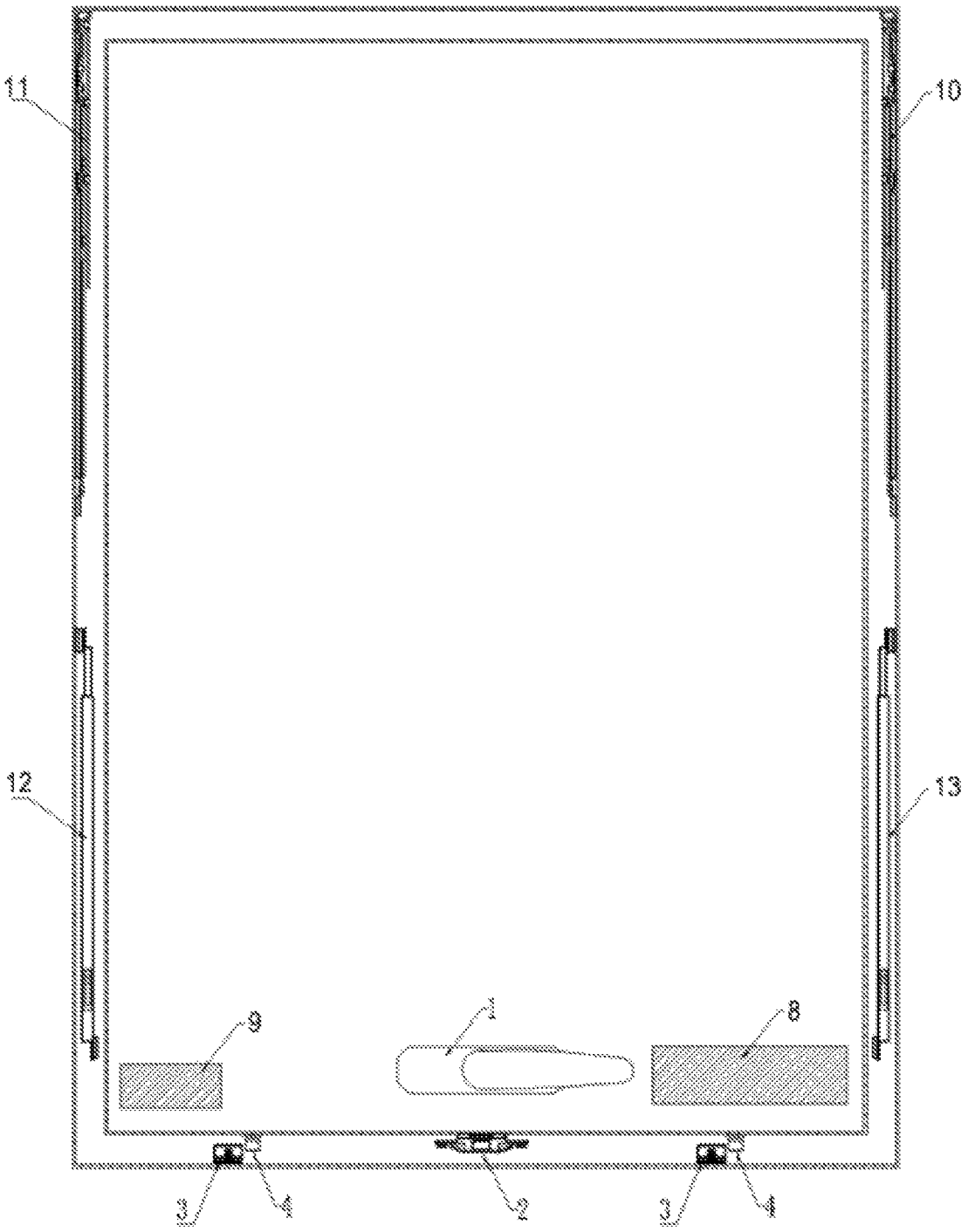
Figure 4:
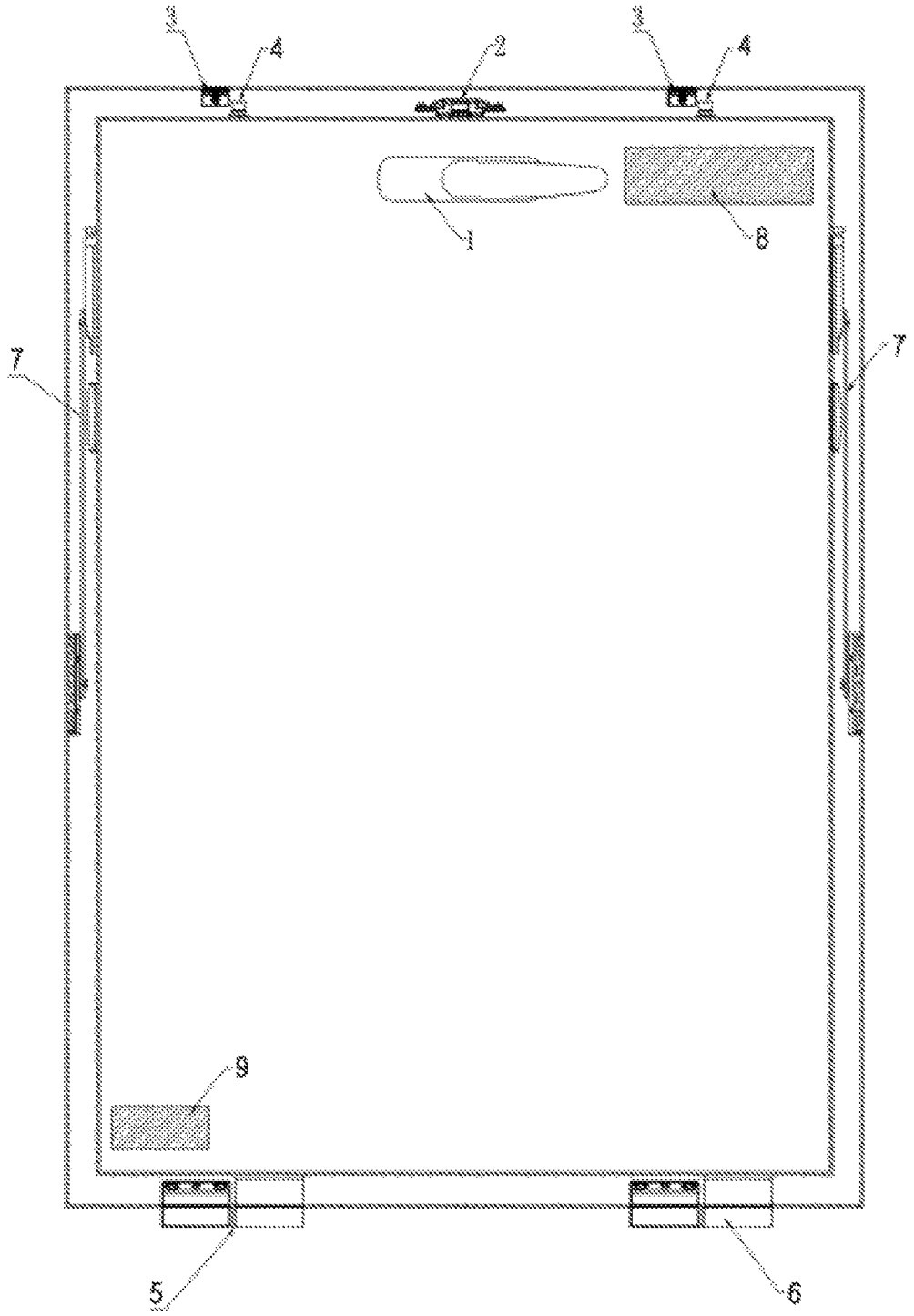
Figure 5:
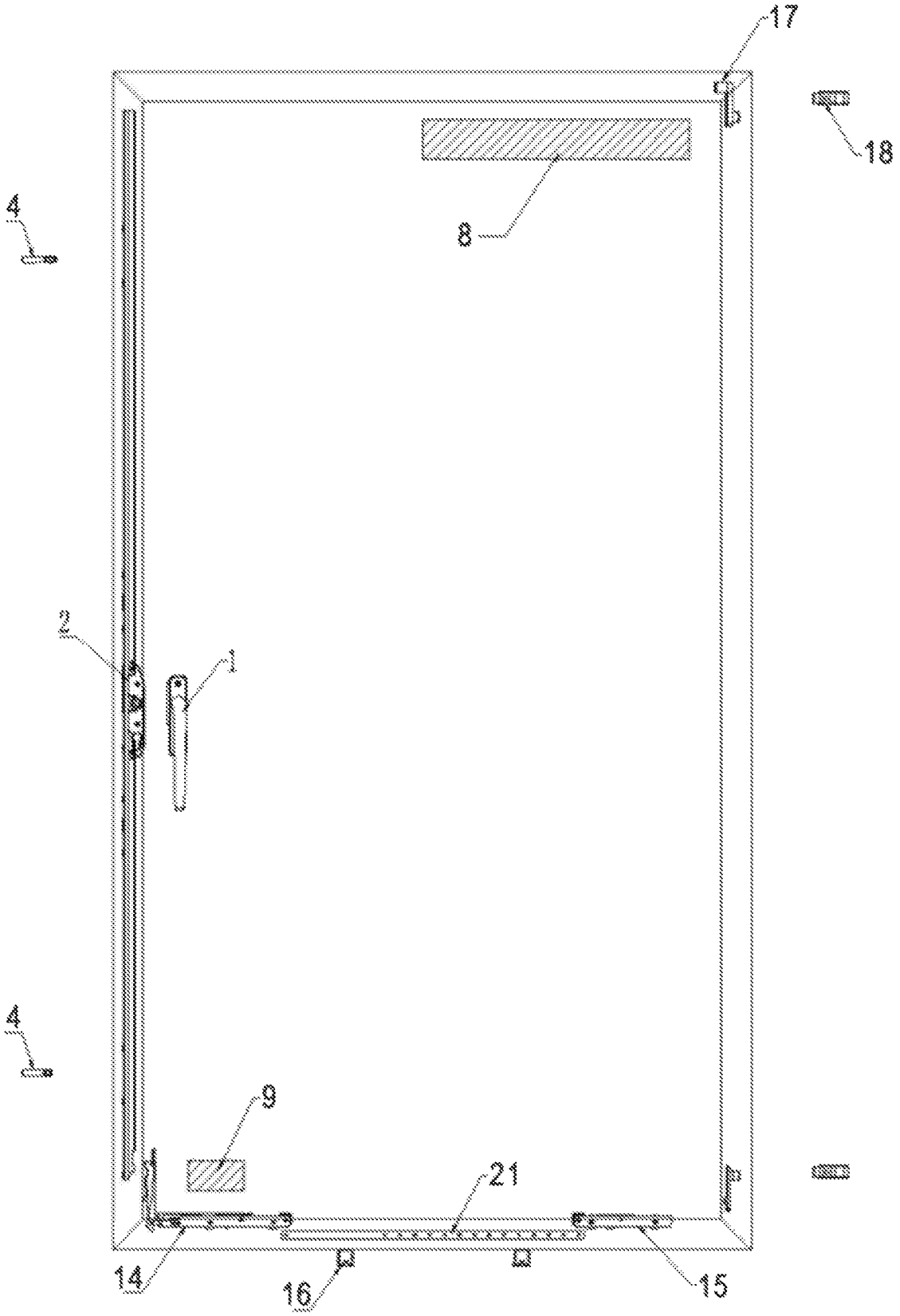
Figure 6:
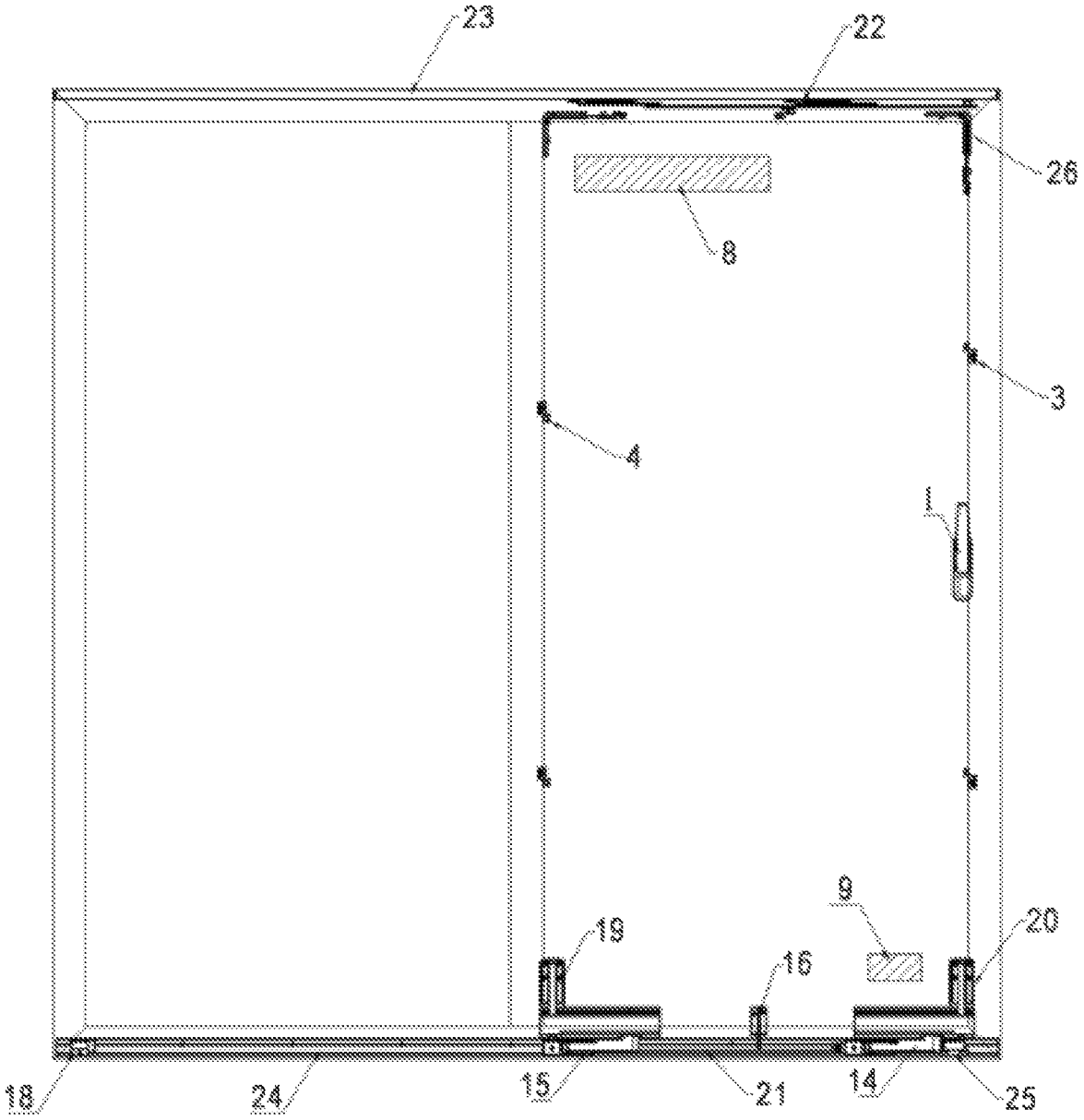

Referring to FIG. 1, it illustrates a type of door or window with a mechanism for automatically detecting faults of the door or window according to an embodiment of the present invention. The door or window shown here is a side-hung type, which is only taken as an example. The mechanism and method for automatically detecting faults of the door or window according to the present invention may further be applied to bilateral-open type, inward-open and inward-tilted, rolling shutter type, hoist-push-pull type, and inward-tilted and push-pull type doors or windows which are opened and controlled in various manners and made of various materials.

As shown in FIG. 1, the side-hung door or window mainly comprises a door or window frame, a door or window leaf and hardware. The hardware mainly comprises a handle, a door lock, a hinge, a door closer and a door holder, and functions to couple, control and fix between components of the door or window and between the door or window and a building main body. The hardware of the side-hung door or window shown in FIG. 1 at least comprises a handle 1, a transmission 2, a lock seat 3, a lock point 4, hinges 5, 6 and a wind brace 7. The hinges 5, 6 are important load-carrying parts between the door or window leaf and the door or window frame, they fix the door or window leaf to a lateral side of the door or window frame and enable the side-hung door or window to rotate upon opening. According to an embodiment of the present invention, a displacement sensor 27 (a magnetically-sensitive reed pipe sensor or other displacement sensors) may be installed on a mounting plate of the hinges 5, 6 for mounting on the door or window leaf and the door or window frame, and on a hinge sheet, for example, a reed pipe is mounted on the mounting plate of the hinges 5, 6 for mounting on the door or window leaf and the door or window frame and a magnet is mounted on the hinge sheet, or a magnet is mounted on the mounting plate of the hinges 5, 6 for mounting on the door or window leaf and the door or window frame, and a reed pipe is mounted on the hinge sheet, to judge relative displacement between the mounting plate of the hinges 5, 6 for mounting on the door or window leaf and the door or window frame and the hinge sheet, for example relative displacement of 1-2 mm. If the relative position therebetween generates a displacement exceeding a threshold, e.g., a displacement exceeding 2 mm, it may be sensed by changes of relative dimensions that the hinges might loose and have a disengagement risk.

As shown in FIG. 1, a displacement sensor 28 (a reed pipe and a magnet or other displacement sensor) may be respectively mounted at locations of the lock seat 3 and lock point 4 of the door or window frame and door or window leaf on the side of the handle 1 to sense relative position changes of the door or window frame and door or window leaf. If a distance between a back plate of the hinges 5, 6 and the hinge sheet changes, this indicates that the hinges might loose and have an disengagement risk, and an amplitude of disengagement or corner drop may be learnt by judging in combination with a sensor between the lock seat 3 and lock point 4 of the door or window frame or door or window leaf on the side of the handle 1. If a displacement change occurs on the side of the hinges 5, 6, the distance between the lock seat 3 and lock point 4 of the door or window frame or door or window leaf on the side of the handle 1 certainly becomes smaller, and thereby it is judged that there is something wrong with the relative position of the door or window frame and door or window leaf, or that there is a serious problem with connection of the hinges.

According to the present invention, it is further feasible to mount the reed pipe and magnet at or nearby hardware used on the door or window or other different positions of the door or window frame and leaf, such as hardware of the handle, transmission, wind brace, door closer and door or window corners, so that relative displacement between different parts is monitored at a plurality of monitoring points of the door or window. If the relative position of a plurality of positions generates a displacement exceeding a threshold, it may be judged that the relative position of the door or window frame and leaf changes, or a screw of individual load-bearing hardware disengages or a part disengages, which causes influence on normal use of the door or window, or might causes injury to the user or other persons. The distance of the above threshold displacement may reach a relative accurate degree by adjusting a sensing distance of the sensor such as the magnet and reed pipe, and different doors or windows vary in terms of the distance to be controlled or sensed.

In addition, a manner of mounting the reed pipe and magnet on the door or window frame and leaf and hardware depends on the structure of the specific hardware or door or window frame and leaf, for example, they may be directly mounted on components, or may be mounted in components and invisible from the surface of components. The mechanism for automatically detecting the door or window faults according to the present invention preferably employs the reed pipe sensor on the grounds that it has characteristics such as simple structure, small size, high speed, long service life, easy installation in a limited space, inconspicuousness, strong resistance against load impact and very high operation reliability.

FIG. 2-FIG. 6 illustrate other types of doors or windows on which the mechanism for automatically detecting faults of the doors or windows according to the present invention is arranged. Arranging positions and structures of hardware for the doors or windows vary with different opening manners of the doors or windows. However, the concept of the mechanism and method of automatically detecting door or window faults is the same as the concept of the mechanism and method of automatically detecting door or window faults of the side-hung door or window as shown in FIG. 1, and will not be detailed here.

Figure 7:
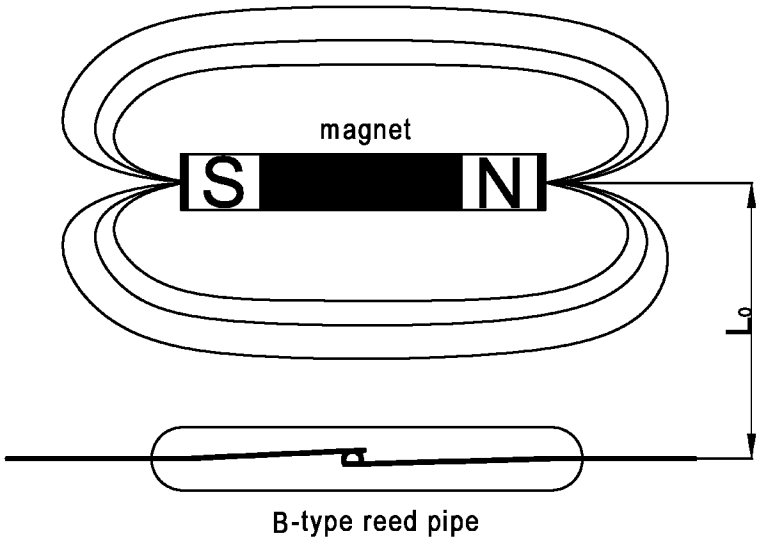
FIG. 7 is a schematic view of a reed pipe sensor.
Figure 7:
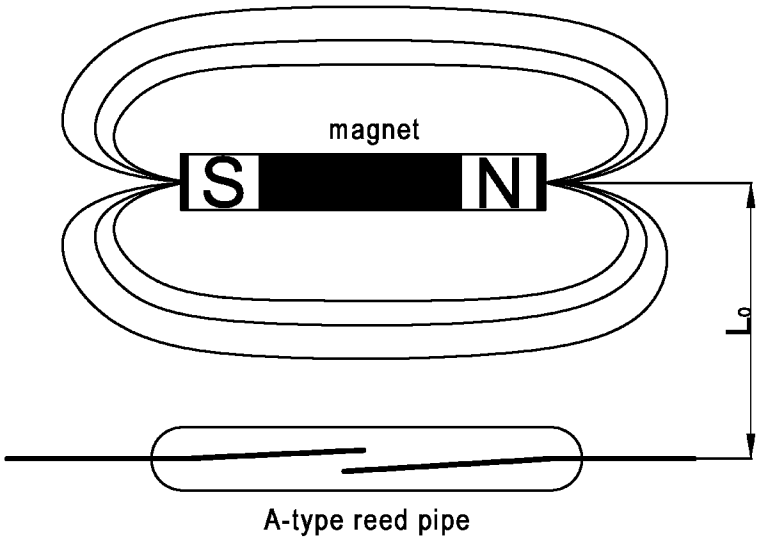

FIG. 7 illustrates a schematic view of A-type reed pipe and B-type reed pipe preferably employed by the present invention, wherein according to contact construction of the reed pipes, A-type reed pipe belongs to a reed switch which is often opened, and B-type reed pipe belongs to a reed switch which is often closed.

Figure 8:
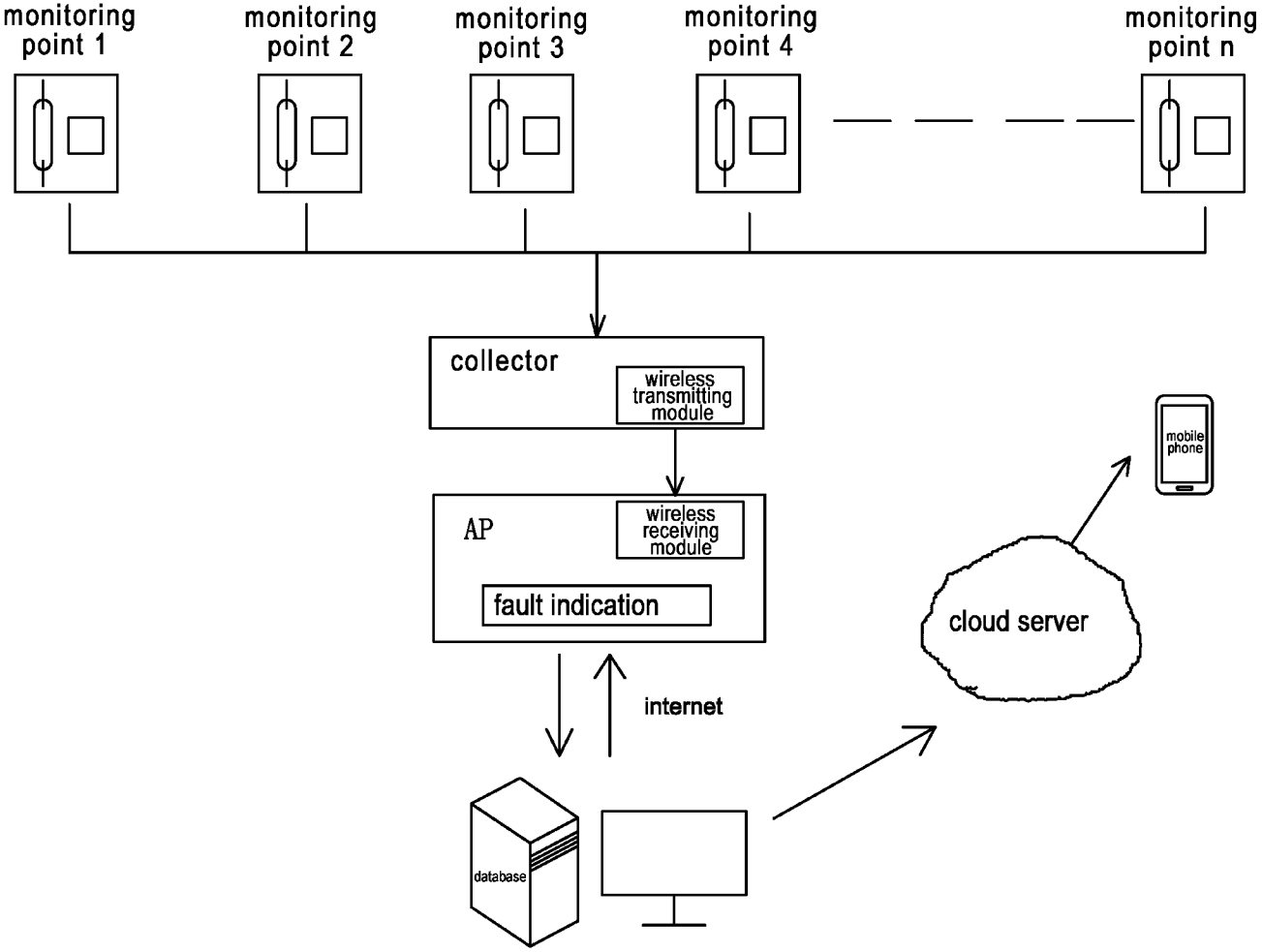
FIG. 8 is a schematic view of a method for automatically detecting faults of the door or window according to an embodiment of the present invention.

FIG. 8 is a schematic view of a method for automatically detecting door or window faults according to an embodiment of the present invention. As shown in FIG. 8, to achieve normal operation of the plurality of door or window sensors and make corresponding logic judgment, the reed pipe sensor or other displacement sensors are disposed at a plurality of monitoring points (1, 2, 3, . . . n) of the door or window hardware and/or door or window frame and leaf to monitor relative displacement between different components. All sensors are connected to a controller (e.g., a wireless collection and communication module 9) with an imbedded type MCU as a core. The controller may comprise a collector and an application processor (AP), the collector has a wireless transmitting module, the application processor has a wireless receiving module, a signal collected by the collector is transmitted by the wireless transmitting module to the application processor and received by a wireless receiving module of the application processor, the application processor performs combined judgment for the received signal and sends fault explanation information. The fault explanation information may be transmitted to a master controller (e.g., an embedded system with MCU or ARM chip architecture) in a wired or wireless transmission manner, A human-machine interaction interface may be used to display a fault code, and indicate information such as faulty door or window or causes for faults or faulty positions. In addition, the fault explanation information may be transmitted to a cloud server by the master controller via a router, then transmitted by the cloud server to the user's mobile phone or other mobile terminals to notify the user of information such as faulty door or window or causes for faults or faulty positions.

It is appreciated that the method and mechanism for automatically detecting door or window faults according to the present invention is not limited to detection of one door or window, and instead, automatic fault detection may further be made for a plurality of doors or windows simultaneously. For example, the method and mechanism may be applied to a plurality of doors and windows in a house, a plurality of doors and windows of several buildings in a residence area, a plurality of doors and windows of one office building, to thereby perform overall monitoring for doors and windows of the whole house, the whole residence area and the whole office building, automatically detect possible faults during use of doors and windows or risks endangering the user's personal safety or other persons' safety, substantially improve monitoring efficiency and safety and exhibit important social significance.

What are described above are only preferred embodiments of the present invention, and not intended to limit the present invention. Those skilled in the art appreciate that the present invention may have various modifications and variations. Any modifications, equivalent substitutes and improvements within the spirit and principles of the present invention all fall within the protection scope of the present invention.

LISTING OF PARTS

1 Handle
2 Transmission
3 Lock seat
4 Lock point
5, 6 Hinge
7, 7.1, 7.2 Wind brace and parts
8 Motor actuator for opening a door or window
9 Wireless collection and communication module
10, 11 Hinge
12, 13 Telescopic arm
14 Driving wheel carrier
15 Driven wheel carrier
16 Bracket
17 Anti-collision block
18 Stopper
19, 20 Wheel carrier fixing sheet
21 Link rod
22 Upper sliding hinge
23 Upper slide rail
24 Lower slide rail
25 Wheel entry block
26 Corner transmission

What is claimed is:

1. A mechanism for automatically detecting a door or window fault when the door or window is closed, characterized in that the mechanism comprises:

a displacement sensor having at least one monitoring position, wherein the displacement sensor is configured to be mounted on a door or window frame and leaf, door or window hardware, or the door or window frame and leaf and the door or window hardware; and a controller connected to the displacement sensor and configured to judge whether a relative position change of the door or window frame and leaf, a relative displacement of the door or window hardware, or the relative position change of the door or window frame and leaf and the relative displacement of the door or window hardware at said at least one monitoring position exceeds a displacement threshold due to shifting of the door or window over time and not based on human interference, and thereby perform combined judgment for door or window fault, wherein the mechanism is configured to automatically detect the relative position change of the door or window frame and leaf, the relative displacement of the door or window hardware, or the relative position change of the door or window frame and leaf and the relative displacement of the door or window hardware when the door or window is closed.

2. The mechanism for automatically detecting the door or window fault according to claim 1, characterized in that the displacement sensor is a reed switch and a magnet.

3. The mechanism for automatically detecting the door or window fault according to claim 2, characterized in that the displacement sensor mounted on the at least one monitoring position of the door or window frame and leaf, the door or window hardware, or the door or window frame and leaf and the door or window hardware comprises a displacement sensor mounted on a mounting plate of a hinge for mounting on the door or window leaf and frame and a hinge sheet, and a displacement sensor mounted at a lock seat and a lock point on the door or window on a side of a handle.

4. The mechanism for automatically detecting the door or window fault according to claim 2, characterized in that the mechanism further comprises a master controller, the fault explanation information sent by the controller being transmitted to the master controller in a wired or wireless transmission manner, the master controller using a human-machine interaction interface to display a fault code and indicate fault information.

5. The mechanism for automatically detecting the door or window fault according to claim 2, characterized in that the mechanism further comprises a master controller, a fault explanation information sent by the controller being transmitted to the master controller in a wired or wireless transmission manner, fault explanation information being transmitted to a cloud server by the master controller via a router, being transmitted to a user's mobile terminal via the cloud server.

6. The mechanism for automatically detecting the door or window fault according to claim 1, characterized in that the displacement sensor mounted on the at least one monitoring position of the door or window frame and leaf, the door or window hardware, or the door or window frame and leaf and the door or window hardware comprises a displacement sensor mounted on a mounting plate of a hinge for mounting on the door or window leaf and frame and a hinge sheet, and a displacement sensor mounted at a lock seat and a lock point on the door or window on a side of a handle.

7. The mechanism for automatically detecting the door or window fault according to claim 1, characterized in that the mechanism further comprises a master controller, fault explanation information sent by the controller being transmitted to the master controller in a wired or wireless transmission manner, the master controller using a human-machine interaction interface to display a fault code and indicate fault information.

8. The mechanism for automatically detecting the door or window fault according to claim 1, characterized in that the mechanism further comprises a master controller, the fault explanation information sent by the controller being transmitted to the master controller in a wired or wireless transmission manner, the fault explanation information being transmitted to a cloud server by the master controller via a router, being transmitted to a user's mobile terminal via the cloud server.

9. The mechanism for automatically detecting the door or window fault according to claim 1, wherein the displacement threshold is approximately 2 mm.

10. The mechanism for automatically detecting the door or window fault according to claim 1, wherein exceeding the displacement threshold is configured to indicate that something is physically wrong with the relative position of the door or the window frame and door or window leaf, or that there is a problem with a connection of a hinge for mounting on the door or window leaf and frame.

11. The mechanism for automatically detecting the door or window fault according to claim 1, wherein an initial position of the door or window when the mechanism is installed is compared to the monitoring position of the door or window as judged by the mechanism to determine whether the difference exceeds the displacement threshold when the door or window is closed.

12. The mechanism for automatically detecting the door or window fault according to claim 1, wherein the combined judgment is not based on human interference which moves the door or window relative to the door or window frame when closed.

13. The mechanism for automatically detecting the door or window fault according to claim 1, wherein the mechanism only forms the combined judgment for the door or window fault when the door or window is closed.

14. A mechanism for automatically detecting a door or window fault when the door or window is in a closed position, characterized in that the mechanism comprises:

a displacement sensor having at least one monitoring position, wherein the displacement sensor is configured to be mounted on a door or window frame and leaf, door or window hardware, or the door or window frame and leaf and the door or window hardware; and a controller connected to the displacement sensor and configured to judge whether a relative position change of the door or window frame and leaf, a relative displacement of the door or window hardware, or the relative position change of the door or window frame and leaf and the relative displacement of the door or window hardware at said at least one monitoring position exceeds a displacement threshold, and thereby perform combined judgment for door or window fault, wherein the mechanism is configured to automatically detect the relative position change of the door or window frame and leaf, the relative displacement of the door or window hardware, or the relative position change of the door or window frame and leaf and the relative displacement of the door or window hardware when the door or window is in the closed position, wherein the displacement threshold for the door or window fault is defined as the relative position change or the relative displacement of a distance of less than approximately 2 mm which occurs over time because of shifting of the relative position change or the relative displacement only when the window or door is in the closed position such that the door or window fault is not based on human interference that moves the door or the window relative to the door or window frame when in the closed position.

15. The mechanism for automatically detecting the door or window fault according to claim 14, wherein exceeding the displacement threshold is configured to indicate that something is physically wrong with the relative position of the door or the window frame and door or window leaf, or that there is a problem with a connection of a hinge for mounting on the door or window leaf and frame.

* * * * *